US006851758B2

(12) United States Patent
Beach

(10) Patent No.: US 6,851,758 B2
(45) Date of Patent: Feb. 8, 2005

(54) ROTATABLE BIT HAVING A RESILIENT RETAINER SLEEVE WITH CLEARANCE

(75) Inventor: Wayne H. Beach, Roaring Spring, PA (US)

(73) Assignee: Kennametal Inc., Latrobe, PA (US)

( * ) Notice: Subject to any disclaimer, the term of this patent is extended or adjusted under 35 U.S.C. 154(b) by 15 days.

(21) Appl. No.: 10/325,311

(22) Filed: Dec. 20, 2002

(65) Prior Publication Data

US 2004/0118615 A1 Jun. 24, 2004

(51) Int. Cl.[7] ..... E21C 37/18

(52) U.S. Cl. ..... 299/107

(58) Field of Search ..... 403/345; 411/338, 411/339, 352, 353, 516–519, 521; 299/107, 79.1

(56) References Cited

U.S. PATENT DOCUMENTS

| | | | | |
|---|---|---|---|---|
| 3,752,515 A | | 8/1973 | Oaks et al. | 287/52 R |
| 3,812,756 A | * | 5/1974 | Wenger | 411/353 |
| 4,201,421 A | | 5/1980 | Den Besten et al. | 299/86 |
| 4,247,147 A | | 1/1981 | Rettkowski | 299/10 |
| 4,327,947 A | * | 5/1982 | Bower, Jr. | 299/107 |
| 4,462,638 A | | 7/1984 | Den Besten et al. | 299/86 |
| 4,484,783 A | | 11/1984 | Emmerich | 299/86 |
| 4,489,986 A | | 12/1984 | Dziak | 299/86 |
| 4,497,520 A | | 2/1985 | Ojanen | 299/86 |
| 4,511,006 A | | 4/1985 | Grainger | 175/57 |
| 4,553,615 A | | 11/1985 | Grainger | 175/329 |
| 4,561,698 A | | 12/1985 | Beebe | 299/86 |
| 4,573,744 A | | 3/1986 | Clemmow et al. | 299/81 |
| 4,575,156 A | | 3/1986 | Hunter et al. | 299/92 |
| 4,582,364 A | | 4/1986 | deMey, III | 299/92 |
| 4,603,911 A | | 8/1986 | Hindmarsh et al. | 299/91 |
| 4,650,253 A | | 3/1987 | Clemmow et al. | 299/81 |
| 4,660,890 A | | 4/1987 | Mills | 299/79 |
| 4,684,176 A | | 8/1987 | Den Besten et al. | 299/91 |
| 4,725,099 A | | 2/1988 | Penkunas et al. | 299/86 |
| 4,818,027 A | * | 4/1989 | Simon | 299/107 |
| 4,836,614 A | | 6/1989 | Ojanen | 299/86 |
| 4,844,550 A | | 7/1989 | Beebe | 299/92 |
| 4,865,392 A | | 9/1989 | Penkunas et al. | 299/86 |

(List continued on next page.)

FOREIGN PATENT DOCUMENTS

| | | | | |
|---|---|---|---|---|
| DE | 2837784 A | * | 3/1980 | E01C/23/08 |
| DE | 3144060 A1 | * | 5/1983 | E21C/25/10 |

OTHER PUBLICATIONS

Texoma Auger Tools Catalog, Reedrill, A division of Metso Minerals, Sherman Texas.

Kennametal Catalog "Cutting and Drilling Systems . . . For Underground and Surface Mining" Cat B00–023(10)JO.

*Primary Examiner*—John Kreck
(74) *Attorney, Agent, or Firm*—Matthew W. Smith

(57) ABSTRACT

A drilling bit for use in conjunction with a holder that has a bore wherein the drilling bit has a drilling bit body that has an axial forward end and an axial rearward end. The drilling bit body further includes a reduced diameter portion adjacent to the axial rearward end thereof so as to define a reduced diameter surface. A hard insert is affixed to the drilling bit body at the axial forward end thereof. A resilient retainer sleeve has a first thickness and presents an interior surface. The retainer sleeve is carried by the drilling bit body within the reduced diameter portion. The resilient retainer sleeve is in an expanded condition when the drilling bit is not within the bore of the holder and the resilient retainer sleeve is in a compressed condition when the drilling bit being within the bore of the holder. The clearance between the reduced diameter surface of the drilling bit body and the interior surface of the resilient retainer sleeve when the resilient retainer sleeve is in its compressed condition is at least as great as the thickness of the resilient retainer sleeve.

34 Claims, 6 Drawing Sheets

U.S. PATENT DOCUMENTS

| | | | | |
|---|---|---|---|---|
| 4,911,503 | A | 3/1990 | Stiffler et al. | 299/79 |
| 4,921,310 | A | 5/1990 | Hedlund et al. | 299/92 |
| 4,938,538 | A | 7/1990 | Larsson et al. | 299/86 |
| 4,940,288 | A | 7/1990 | Stiffler et al. | 299/79 |
| 4,941,711 | A | 7/1990 | Stiffler | 299/79 |
| RE33,494 | E | 12/1990 | Hindmarsh et al. | 299/91 |
| 4,981,328 | A | 1/1991 | Stiffler et al. | 299/79 |
| 5,141,289 | A | 8/1992 | Stiffler | 299/79 |
| 5,161,859 | A | 11/1992 | Larsson et al. | 299/86 |
| 5,219,209 | A | 6/1993 | Prizzi et al. | 299/86 |
| 5,261,499 | A | 11/1993 | Grubb | 175/427 |
| 5,273,343 | A | 12/1993 | Ojanen | 299/10 |
| 5,303,984 | A | 4/1994 | Ojanen | 299/86 |
| 5,366,031 | A | 11/1994 | Rickards | 175/354 |
| 5,392,870 | A | 2/1995 | Clapham et al. | 175/427 |
| 5,400,861 | A | 3/1995 | Sheirer | 175/427 |
| 5,415,462 | A | 5/1995 | Massa | 299/86 |
| 5,427,191 | A | 6/1995 | Rickards | 175/354 |
| 5,456,522 | A | 10/1995 | Beach | 299/113 |
| 5,503,463 | A | 4/1996 | Ojanen | 299/107 |
| 5,628,549 | A | 5/1997 | Ritchey et al. | 299/104 |
| 5,632,527 | A | 5/1997 | Halder | 299/100 |
| 5,645,323 | A | 7/1997 | Beach | 299/111 |
| 5,730,502 | A | 3/1998 | Montgomery, Jr. | 299/104 |
| 6,196,636 | B1 | 3/2001 | Mills et al. | 299/111 |
| 6,354,771 | B1 | 3/2002 | Bauschulte et al. | 407/114 |
| 6,357,832 | B1 | 3/2002 | Sollami | 299/104 |
| 6,375,272 | B1 | 4/2002 | Ojanen | 299/111 |
| 6,478,383 | B1 | 11/2002 | Ojanen et al. | 299/104 |
| 2002/0153175 | A1 * | 10/2002 | Ojanen | 175/427 |

* cited by examiner

ROTATABLE BIT HAVING A RESILIENT RETAINER SLEEVE WITH CLEARANCE

FIELD OF THE INVENTION

The present invention pertains to a rotatable bit that in operation rotates about its central longitudinal axis so as to engage a substrate such as, for example, earth strata. More specifically, the invention pertains to such a rotatable bit that includes a resilient retainer sleeve wherein the rotatable bit is held via the resilient retainer sleeve within the bore of a holder that is a part of an assembly used to engage the earth strata.

BACKGROUND OF THE INVENTION

There are a number of different types of circumstances (or applications) wherein a rotatable bit is used to engage a substrate (e.g., earth strata). These different circumstances use assemblies such as a rotary drum, a cutting chain, a scrapper (or scarifier) blade, and drilling equipment (e.g., augers). Examples of these applications include underground mining, surface mining, dredging, construction road planning, trenching, road grading, and snow/ice removal.

In some of the above applications, the rotatable bit is subjected to an intermittent type of engagement (or cutting) of the substrate. For example, when a rotatable bit is mounted to a rotary drum of a road planning machine, the bit cycles in and out of engagement with the substrate (e.g., the cut) as the drum rotates. The same is true with respect to a rotatable bit used on a cutter chain. Even in scrapper blade applications the rotatable bit experiences an intermittent engagement (or cutting action) with the earth strata due to the fact that the rotatable bits periodically are not in engagement with the earth strata when the blade passes over low areas of the substrate surface.

In intermittent engagement applications, such as, for example, road planning, at any one time there are a number of the rotatable bits that are not in engagement with the substrate. When the rotatable bits that are in engagement with the substrate encounter an obstacle (e.g. a man hole cover) the rotational speed of the drum quickly reduces so that the forces exerted on the rotatable bit operate so as to try to eject the rotatable bit from the bore of the holder. Unless there is sufficient force to retain the rotatable bit in its holder, these forces will eject the rotatable bit from the bore of its holder. In order to maintain the rotatable bit in its holder, it has been necessary to use a retainer that has radially outwardly projecting dimples. This type of arrangement is along the lines of the block-rotatable tool combination disclosed in U.S. Pat. No. 3,752,515 to Oaks et al.

In the arrangement such as disclosed in U.S. Pat. No. 3,752,515, the bore has an annular groove near the rearward end of the bore. Each rotatable bit has a rearward shank that contains a reduced diameter portion that carries a resilient retainer ring that has a plurality of radial outwardly projecting dimples. When the rotatable bit is inserted into the bore, the resilient retainer ring is compressed as the drilling bit slides (or is forced) into the bore. At the point wherein the dimples register with the annular groove, the resilient retainer ring expands so that the dimples are received within the annular groove. The reception (or engagement) of the dimples by the annular groove retains the rotatable bit within the bore of the holder during the operation of the assembly.

Another arrangement designed to retain a rotatable bit in a bore of a holder is disclosed in U.S. Pat. No. 4,201,421 to Den Besten et al. In this arrangement, the long resilient retainer sleeve extends for a substantial length of the shank of the rotatable bit. The fact that the sleeve extends along a substantial length of the shank provides for sufficient force to retain the rotatable bit in the bore of the holder. The long resilient retainer sleeve has been used on rotatable bits employed in road planning applications.

In the past, drilling assemblies have been used to drill holes in substrates such as earth strata. One version of such a drilling assembly is a bullet tooth rock auger sold by Reedrill, a division of Metso Minerals of Sherman, Tex., as a Texoma® auger tool. This bullet tooth rock auger comprises an auger that includes a central shaft with a helical auger flight affixed to the central shaft. A plurality of holders are affixed to the distal end of the central shaft. The helical auger flight has a peripheral edge. Holders are affixed to the lower portion of the helical auger flight at the peripheral edge thereof.

In a drilling operation, the rotatable bit is in constant contact (or engagement) with the substrate (e.g., earth strata). As a result, there is not the sudden force exerted on the rotatable bit to eject the bit from the holder. This means that there is not the same requirement for a retainer that retains the rotatable bit in the bore of the holder against a sudden ejecting force. However, even though the requirement for the retaining force is not as great in a drilling application as other applications, heretofore, rotatable bits used in drilling applications (i.e., drilling bits) still use a retainer such as in U.S. Pat. No. 3,752,515 to Oaks et al.

To eject the drilling bit from the bore of the holder, the operator strikes the rear end of the drilling bit. Such an impact forces the drilling bit from the bore of the holder. It is intended that upon striking the drilling bit, the resilient retainer ring will be compressed so that there no longer is any engagement of the dimples by the annular groove. The drilling bit then can be forced out of the bore by additional impacts on the rearward end of the drilling bit.

During the drilling operation, there is a build up of dirt and other debris in the bore of the holder. Some of this debris collects between the resilient retainer ring and the reduced diameter portion of the drilling bit. The presence of this debris between the resilient retainer ring and the reduced diameter portion of the drilling bit obstructs the compression of the retainer ring. This makes it difficult for the retainer ring to compress when the operator strikes the rear end of the drilling bit. In those cases where the resilient retainer ring does not fully compress, the dimples must be sheared off in order for the drilling bit to be extracted from the bore of the holder. As can be appreciated, it can sometimes take a lot of effort and time to remove drilling bits from their corresponding holders if the dimples have to be sheared off to remove the drilling bit because the resilient ring experiences difficulty compressing due to the presence of the debris between the resilient retainer ring and the reduced diameter portion of the drilling bit. An increase in the time and effort needed to remove the drilling bits increases the overall cost of a drilling operation.

It would very desirable to provide an improved drilling bit that is not susceptible to difficulties associated with the built up (or accumulation) of debris between the resilient retainer ring and the reduced diameter portion of the drilling bit. More specifically, it would be desirable to provide an improved drilling bit wherein the resilient retainer is not susceptible to an inability to compress due to the collection of dirt and debris between the retainer and the reduced diameter portion of the drilling bit.

SUMMARY OF THE INVENTION

In one form, the invention is a drilling bit for use in conjunction with a holder that has a bore wherein the drilling bit comprises a drilling bit body that has an axial forward end and an axial rearward end. The drilling bit body further includes a reduced diameter portion adjacent to the axial rearward end thereof so as to define a reduced diameter surface. The drilling bit further includes a hard insert that is affixed to the drilling bit body at the axial forward end thereof. The drilling bit also includes a resilient retainer sleeve that has a first thickness and presents an interior surface. The retainer sleeve is carried by the drilling bit body within the reduced diameter portion. The resilient retainer sleeve is in an expanded condition when the drilling bit is not within the bore of the holder. The resilient retainer sleeve is in a compressed condition when the drilling bit is within the bore of the holder. The clearance between the reduced diameter surface of the drilling bit body and the interior surface of the resilient retainer sleeve when the resilient retainer sleeve is in its compressed condition is at least as great as the first thickness of the resilient retainer sleeve.

In still another form the invention is a rotatable bit assembly for use in an operation to engage a substrate wherein the rotatable bit is in generally continuous engagement with the substrate. The assembly comprises a holder that has a bore. The assembly further includes a rotatable bit with a rotatable bit body that has an axial forward end and an axial rearward end. The rotatable bit body further includes a reduced diameter portion adjacent to the axial rearward end thereof so as to define a reduced diameter surface. The rotatable bit further includes a hard insert that is affixed to the rotatable bit body at the axial forward end thereof. The rotatable bit also includes a resilient retainer sleeve that has a first thickness and presents an interior surface. The retainer sleeve is carried by the rotatable bit body within the reduced diameter portion. The resilient retainer sleeve is in an expanded condition when the rotatable bit is not within the bore of the holder. The resilient retainer sleeve is in a compressed condition when the rotatable bit is within the bore of the holder. The clearance between the reduced diameter surface of the rotatable bit body and the interior surface of the resilient retainer sleeve when the resilient retainer sleeve is in its compressed condition is at least as great as the thickness of the resilient retainer sleeve.

In yet another form thereof, the invention is a resilient retainer sleeve for use on a rotatable drilling bit retained in a bore of a holder wherein the drilling bit body has an axial forward end and an axial rearward end with a shank adjacent the axial rearward end. The drilling bit body further includes a reduced diameter portion in the shank that defines a reduced diameter surface. The resilient retainer sleeve comprises a retainer sleeve body that has a first thickness and presents an interior surface. The retainer sleeve body is carried by the drilling bit body within the reduced diameter portion. The retainer sleeve body is in an expanded condition when the drilling bit is not within the bore of the holder and the retainer sleeve body is in a compressed condition when the drilling bit being within the bore of the holder. The clearance between the reduced diameter surface of the drilling bit body and the interior surface of the retainer sleeve body (when the retainer sleeve body is in its compressed condition) is at least as great as the thickness of the retainer sleeve body.

In yet another form thereof, the invention is an auger drill for engaging a substrate wherein the auger drill comprises a central auger shaft with a helical flight on the auger shaft. The helical flight has a leading edge. At least one drilling bit is connected to the helical flight adjacent the leading edge wherein the drilling bit is retained in a bore of a holder. The drilling bit comprises a drilling bit body that has an axial forward end and an axial rearward end. The drilling bit body further includes a reduced diameter portion adjacent to the axial rearward end thereof defining a reduced diameter surface. A hard insert is affixed to the drilling bit body at the axial forward end thereof. A resilient retainer sleeve has a first thickness and presents an interior surface. The retainer sleeve is carried by the drilling bit body within the reduced diameter portion. The resilient retainer sleeve is in an expanded condition when the drilling bit is not within the bore of the holder and the resilient retainer sleeve is in a compressed condition when the drilling bit being within the bore of the holder. The clearance between the reduced diameter surface of the drilling bit body and the interior surface of the resilient retainer sleeve when the resilient retainer sleeve is in its compressed condition is at least as great as the first thickness of the resilient retainer sleeve.

In still another form thereof, the invention is a drilling bit for use in conjunction with a holder having a bore. The drilling bit comprises a drilling bit body that has an axial forward end and an axial rearward end, and a reduced diameter portion (that has a diameter) adjacent to the axial rearward end thereof so as to define a reduced diameter surface. A hard insert is affixed to the drilling bit body at the axial forward end thereof. A resilient retainer sleeve has a first thickness and presents an interior surface. The retainer sleeve is carried by the drilling bit body within the reduced diameter portion. The ratio of the first thickness of the resilient retainer sleeve to the diameter of the reduced diameter portion ranges between about 0.08 and about 0.12.

In another form thereof, the invention is an auger drilling bit body retainer sleeve for use on a rotatable drilling bit body wherein the drilling bit body further includes a reduced diameter portion. The retainer sleeve comprises a retainer sleeve body that has a thickness and presents an exterior surface that is generally smooth. The retainer sleeve body is carried by the drilling bit body within the reduced diameter portion. The retainer sleeve body has a first axial length. The reduced diameter portion has a first diameter. The first axial length of the retainer sleeve body is less than the first diameter of the reduced diameter portion.

In yet another form thereof, the invention is a drilling bit that comprises a drilling bit body that has an axial forward end and an axial rearward end. The drilling bit body further includes a reduced diameter portion adjacent to the axial rearward end thereof wherein the reduced diameter portion has a groove diameter. The drilling bit body also includes a larger diameter shank portion axial forward of the reduced diameter portion wherein the larger diameter shank portion has a shank diameter. There is a hard insert that is affixed to the drilling bit body at the axial forward end thereof. A resilient retainer sleeve is carried by the drilling bit body within the reduced diameter portion wherein the resilient retainer sleeve has a thickness that is less than or equal to one-half of the dimensional difference between the shank diameter and the groove diameter.

In still another form thereof, the invention is a drilling bit that comprises a drilling bit body that has an axial forward end and an axial rearward end. The drilling bit body further includes a reduced diameter portion adjacent to the axial rearward end thereof wherein the reduced diameter portion has a groove diameter. The drilling bit body also includes a larger diameter shank portion axial forward of the reduced diameter portion wherein the larger diameter shank portion has a shank diameter. A hard insert is affixed to the drilling bit body at the axial forward end thereof. A resilient retainer sleeve is carried by the drilling bit body within the reduced diameter portion. The resilient retainer sleeve has an exterior surface that is generally smooth. The ratio of the groove diameter to the shank diameter ranges between about 0.69 and about 0.80.

BRIEF DESCRIPTION OF THE DRAWINGS

The following is a brief description of the drawings wherein these drawings form a part of this patent application.

DETAILED DESCRIPTION OF SPECIFIC EMBODIMENTS

Figure 1:
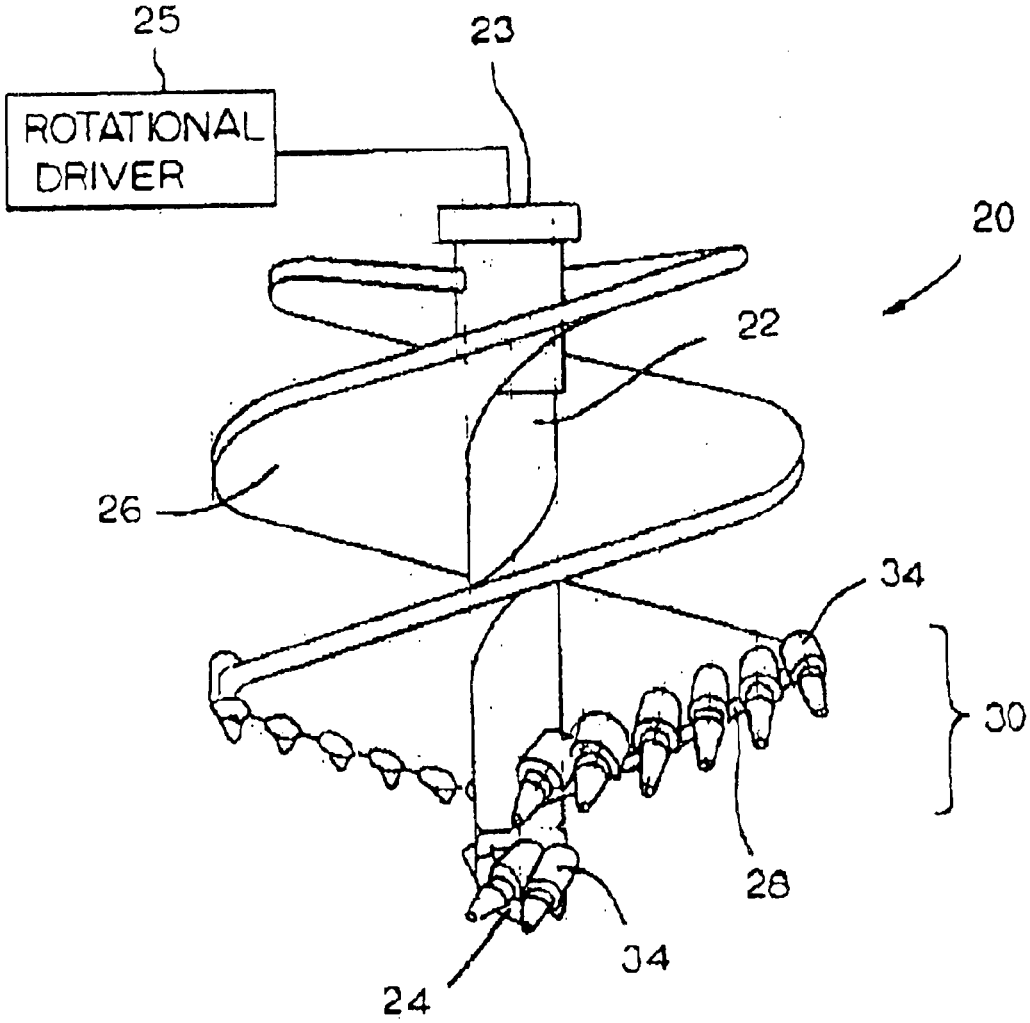
FIG. 1 is a side view of the lower portion of an auger, which is a drilling assembly, wherein the lower flight of the auger carries a plurality of holders and drilling bits, and the pressure auger is shown in schematic as operatively connected to a rotational driver.
Figure 2:
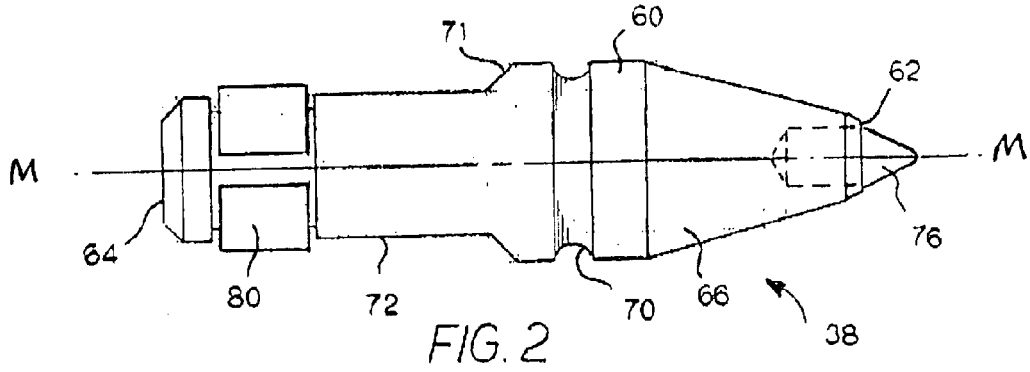
FIG. 2 is a side view of the bit body of one of the rotatable bits (or drilling bits) shown in FIG. 1 wherein the resilient retainer sleeve is contained within the reduced diameter portion of the drilling bit body adjacent the axial rearward end of the drilling bit body and the resilient retainer sleeve is shown in an expanded condition.

Referring to the drawings, FIG. 1 illustrates a drilling apparatus (an auger drill for engaging a substrate) that is a bullet tooth rock auger and is generally designated as 20. Although the specific embodiment illustrated herein is a drilling apparatus, it should be appreciated that the invention may have application to other types of assemblies that engage a substrate. Auger 20 includes a central auger shaft 22 that has an upper end 23 and a distal (or lower) end 24. In operation, the distal end 24 of the auger 20 is in contact with the substrate that is being (or to be) drilled. The auger 20 is operatively connected at the upper end 23 of the auger shaft 22 to a rotational driver (shown in schematic) 25. The rotational driver 25 comprises a conventional rotational driver. The rotational driver 25 provides rotational movement to the drilling apparatus 20 so as to allow it to perform its drilling function.

The drilling apparatus 20 also includes a helical auger flight 26 on the auger shaft 22 wherein the auger flight 26 has a leading edge 28. The helical auger flight 26 has the shape of a helix that essentially is generally spiral in shape.

The lower portion (shown by brackets 30 in FIG. 1) of the auger flight 26 has at least one (e.g., a plurality of) drilling bit assemblies 34 affixed (e.g. welded) to the peripheral edge 28 thereof. The distal end 24 of the central shaft 22 has a plurality of drilling assemblies 34 affixed (e.g. welded) thereto. In this specific embodiment, each drilling assembly 34 is a separate and distinct structure that is affixed to the auger flight 26. Yet, applicant contemplates that the drilling assembly may comprise a single member that contains a plurality of bores wherein a drilling bit is retained within each bore.

Figure 5:
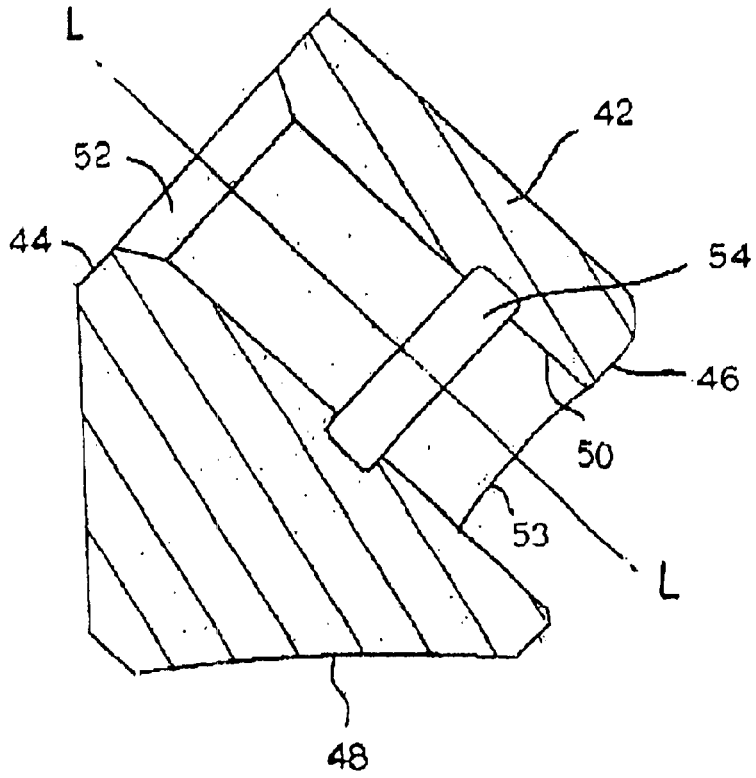
FIG. 5 is a cross-sectional view of one of the holders shown in FIG. 1 hereof wherein there is an annular groove contained in the bore of the holder.

Each drilling assembly 34 comprises two principal parts; namely, the holder generally referred to as 36 and the rotatable bit (or the drilling bit) generally referred to as 38. In regard to one specific embodiment of the holder 36 and referring to FIG. 5, the holder 36 includes a holder body 42 that is typically made of steel. The holder body 42 presents a generally flat forward face 44, a rearward face 46, and a generally arcuate bottom face 48. The holder body 42 contains a generally smooth bore 50 that passes completely through the holder body 42. Bore 50 has a central longitudinal axis L—L. The bore 50 has an open forward end at which there is a frusto-conically shaped mouth 52. The bore 50 also has an open rearward end 53. The bore 50 contains an annular groove 54 near (but spaced in an axial forward direction from) the rearward end 53 of the bore 50. The holder body 42 is affixed (such as, for example by welding) at the bottom face 48 (of the holder body 42) to the distal end 24 of the central shaft 22 and to the peripheral edge 28 of the lower portion (30) of the auger flight 26.

Figure 5A:
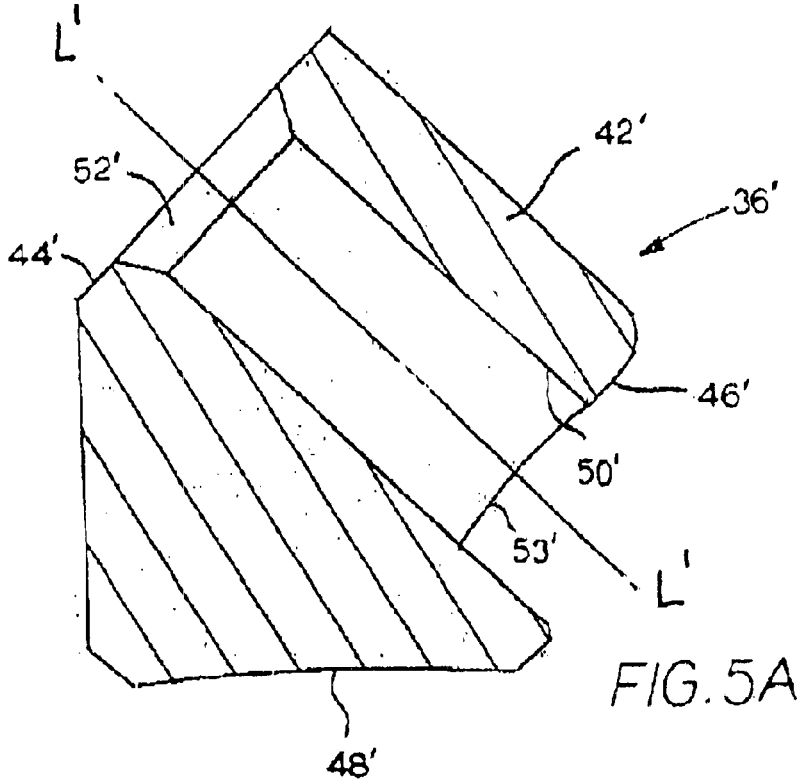
FIG. 5A is a cross-sectional view of another specific embodiment of a holder that retains a drilling bit wherein the bore of the holder does not have an annular groove contained therein.

FIG. 5A illustrates another specific embodiment of a holder generally designated as 36'. Holder 36' has a holder body 42' that is typically made of steel. Holder body 42' includes a forward face 44', a rearward face 46', and a bottom face 48'. The holder body 42' contains a generally smooth bore 50' that passes there through. Bore 50' has a central longitudinal axis L'—L'. The bore 50' does not contain an annular groove or the like. The bore 50' has an open forward end at which there is a frusto-conically shaped mouth 52'. The bore 50' also has an open rearward end 53'. The holder body 42' is affixed (such as, for example by welding) at the bottom face 48' thereof to a supporting surface or structure. In this case, the holder body 42' made be affixed, such as by welding, to the distal end 24 of the central shaft 22 and the peripheral edge 28 of the lower portion (30) of the auger flight 26.

Referring to FIGS. 2, 3, 4 and 4A, the drilling bit 38 is a drilling designed for use in conjunction with a holder that has a bore (e.g., holder 36 with bore 50). Drilling bit 38 is intended (along with the holder 36) for use in an operation (or application) to engage the substrate (e.g., earth strata) wherein the drilling bit 38 is in generally (or substantially) continuous engagement with the substrate. Drilling bit 38 includes a drilling bit body 60 that includes an axial forward end 62 and an axial rearward end 64. Drilling bit 38 has a central longitudinal axis M—M. In operation, the drilling bit 38 is rotatable about its central longitudinal axis M—M (i.e., the bit 38 is a rotatable bit).

Figure 3:
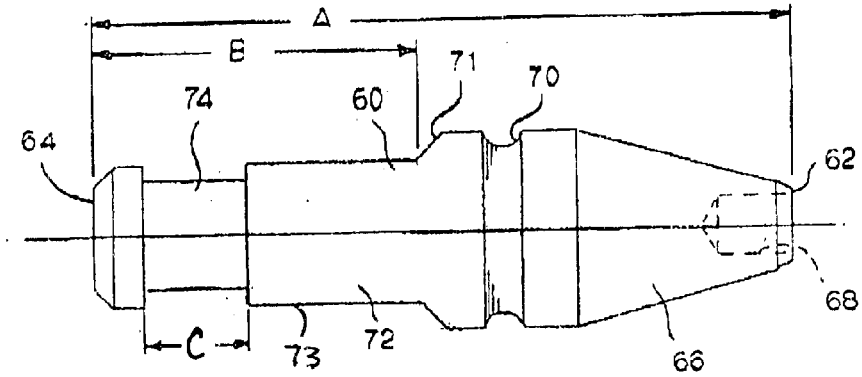
FIG. 3 is a side view of the bit body of the drilling bit shown in FIG. 2 wherein the hard insert has been removed from the socket (shown by dashed lines)in the axial forward end of the drilling bit body and the resilient retainer has been removed from the reduced diameter portion of the drilling bit body.

The overall axial length of drilling bit body 60 is shown by dimension "A" in FIG. 3. The typical range for dimension "A" is between about 2 inches [56 millimeters] and about 7 inches [178 millimeters]. A more preferred range for dimension "A" is between about 3.3 inches [85 millimeters] and about 5 inches [127 millimeters]. A most preferred range for dimension "A" is between about 4.6 inches [118 millimeters] and about 5 inches [127 millimeters].

The drilling bit body 60 also has a head portion 66 near the axial forward end 62. The drilling bit body 60 contains a socket 68 in the axial forward end 62 thereof. The socket 68 may take on any one of a number of different commonly known shapes. The head portion 66 of the drilling bit body 60 contains an annular puller groove 70, as well as a rearward facing frusto-conical surface 71.

Figure 6:
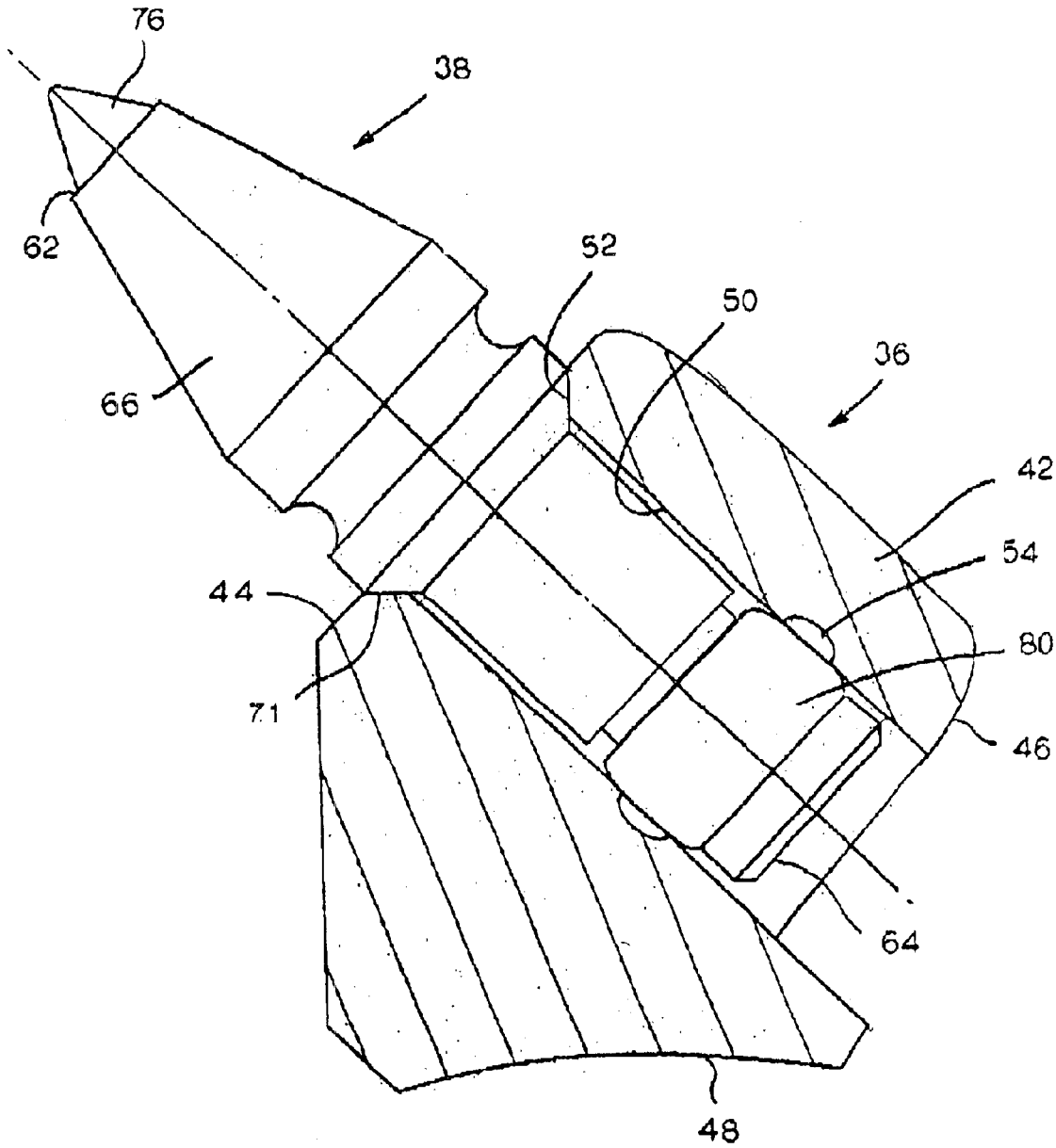
FIG. 6 is a side view of the assembly of the drilling bit shown in FIG. 2 and the holder shown in FIG. 5 wherein the resilient retainer sleeve is in a compressed condition and the holder is shown in cross-section.

The drilling bit body 60 further includes a shank portion 72 near the axial rearward end 64 of the drilling bit body 60. The axial length of the shank portion 72 is shown by dimension "B" in FIG. 3. The typical range for dimension "B" is between about 0.9 inches [24 millimeters] and about 3 inches [76 millimeters]. A more preferred range for dimension "B" is between about 1.6 inches [41 millimeters] and about 2.3 inches [58 millimeters]. As shown in FIG. 6, the entire length of the shank portion 72 is contained within the bore 50 of the holder body 42.

The shank portion 72 includes an axial forward larger diameter portion 73. The shank portion 72 further contains a reduced diameter portion 74 near or adjacent to the axial rearward end 64. In the specific embodiment, the reduced diameter portion 74 is spaced axial forward of the axial rear end 64 of the bit body 60. The reduced diameter portion 74 defines a reduced diameter surface 75. The axial length of the reduced diameter portion 74 is shown by dimension "C" in FIG. 3. The typical range for dimension "C" is between about 0.23 inches [6 millimeters] and about 1.1 inches [28 millimeters]. A more preferred range for dimension "C" is between about 0.23 inches [6 millimeters] and about 0.65 inches [17 millimeters].

The drilling bit 38 further includes a hard insert 76 affixed into the socket 68 at the axial forward end 62 of the drilling bit body 60. Hard insert 76 is typically made of a cemented carbide and is brazed into the socket 68. An exemplary grade of cemented carbide for the hard insert 76 has a composition of about 90.5 weight percent tungsten carbide and 9.5 weight percent cobalt. An exemplary braze alloy to braze the hard insert into the socket is sold under the designations HI-TEMP 080 and HI-TEMP 548 by Handy & Harman, 859 Third Avenue, New York, N.Y. 10022. This braze alloy is a copper-zinc-nickel-manganese-silicon braze alloy. This braze alloy is described in more detail in U.S. Pat. No. 5,219,209 to Prizzi et al. that is incorporated by reference herein.

The drilling bit 38 further includes a resilient retainer sleeve 80. Retainer sleeve 80 has opposite ends 82 and 84, as well as an exterior surface 86 and an interior surface 88. The exterior surface 86 is generally smooth. The interior surface 88 is also generally smooth.

Figure 4:
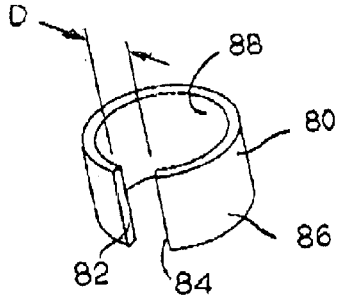
FIG. 4 is an isometric view of the resilient retainer sleeve from the drilling bit shown in FIG. 2.

The resilient retainer sleeve 80 is carried by the drilling bit body 60 within the reduced diameter portion 74. As will be described hereinafter, when the drilling bit 38 is within the bore 50 of the holder 36, the resilient retainer sleeve 80 is in a fully compressed condition. When the drilling bit 38 is not within the bore 50 of the holder 36, the resilient retainer sleeve 80 is in a fully expanded condition. In the fully expanded condition as shown in FIG. 4, the distance between the opposite ends (82, 84) of the resilient retainer ring 80 is shown by dimension "D" in FIG. 4. The typical range for dimension "D" is between about 0.20 inches [5 millimeters] and about 0.62 inches [16 millimeters]. When the sleeve 80 is in the expanded condition, resilient retainer sleeve 80 has a maximum transverse dimension "E" shown in FIG. 4A. The typical range for dimension "E" is between about 0.46 inches [12 millimeters] and about 1.25 inches [32 millimeters]. A more preferred range for dimension "E" is between about 0.82 inches [21 millimeters] and about 1.04 inches [26 millimeters].

Figure 4A:
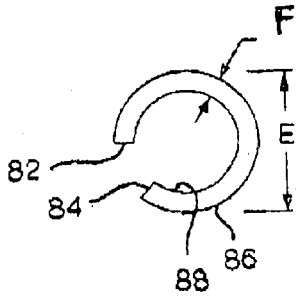
FIG. 4A is an end view of the resilient retainer sleeve shown in FIG. 4.

As shown in FIG. 4A, resilient retainer sleeve 80 has a thickness shown by dimension "F". The typical range for dimension "F" is between about 0.03 inches [0.8 millimeters] and about 0.08 inches [2.0 millimeters]. A more preferred range for dimension "F" is between about 0.04 inches [1.0 millimeters] and about 0.06 inches [1.5 millimeters].

Figure 7:
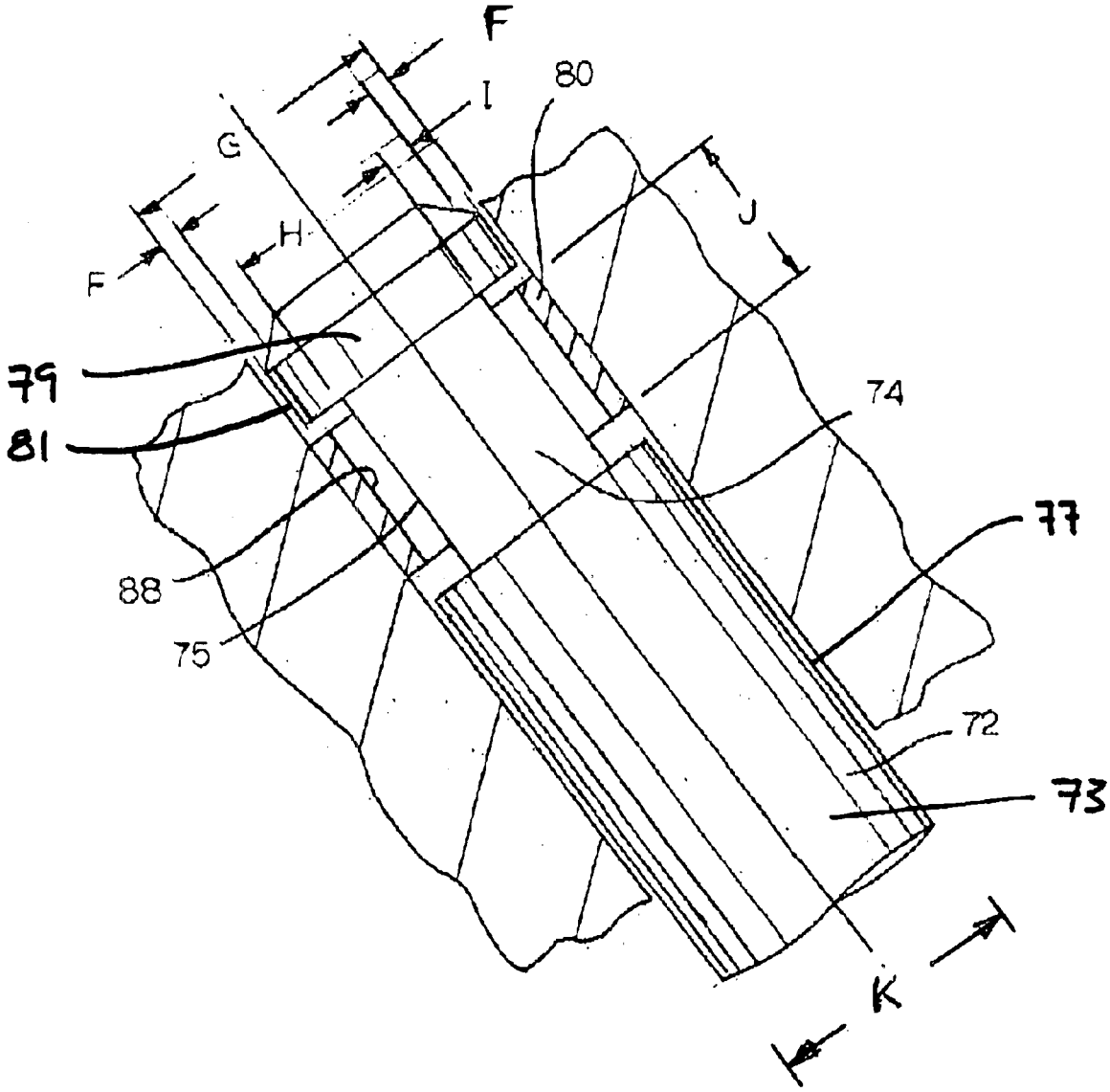
FIG. 7 is a side view of the axially rearward portion of the assembly of the drilling bit and its corresponding holder shown in FIG. 5 wherein the holder and the resilient retainer sleeve (in a compressed condition) are each shown in cross section so as to illustrate the clearance between the interior surface of the resilient retainer sleeve and the surface of the reduced diameter portion of the drilling bit body.

Referring to FIGS. 6 and 7, there is shown the drilling bit 38 retained within the bore 50 of the holder 36. The resilient retainer sleeve 80 is in a compressed condition so as to exert a radial outward force on the wall of the bore 50 whereby the exterior surface 86 of the resilient retainer sleeve 80 is in a tight frictional engagement with the wall of the bore 50. Although the holder 36 shown in FIG. 6 includes an annular groove 54, the resilient retainer does not utilize the annular groove 54 to retain the drilling bit 38 within the bore 50 of the holder 36. When the resilient retainer sleeve 80 is in a tight frictional engagement with the wall of the bore 50, the drilling bit body 60 is able to rotate relative to the resilient retainer sleeve 80 and the holder 36.

Referring to FIG. 7, there is shown the details of the relationship between the resilient retainer sleeve 80 and the reduced diameter portion 74 of the drilling bit body 60. In this regard, the resilient retainer sleeve 80 has compressed outside (or external) transverse dimension "G" as shown in FIG. 7. The typical range for dimension "G" is between about 0.46 inches [12 millimeters] and about 1.50 inches [38 millimeters]. A more preferred range for dimension "G" is between about 0.78 inches [20 millimeters] and about 1.00 inches [25 millimeters].

As also shown in FIG. 7, the diameter of the reduced diameter portion 74 of the drilling bit body 60 is shown by dimension "H". The typical range for dimension "H" is between about 0.25 inches [6 millimeters] and about 1.10 inches [28 millimeters]. A more preferred range for dimension "H" is between about 0.55 inches [14 millimeters] and about 0.73 inches [19 millimeters]. The ratio of the thickness "F" of the resilient retainer sleeve 80 to the diameter "H" of the reduced diameter portion 74 ranges between about 0.08 and 0.12.

FIG. 7 shows the clearance between the interior surface 88 of the resilient retainer sleeve 80 and the reduced diameter surface 75 of the reduced diameter portion 74 wherein this clearance is shown by dimension "I". The typical range for dimension "I" is between about 0.03 inches [0.8 millimeters] and about 0.25 inches [6 millimeters]. A more preferred range for dimension "I" is between about 0.04 inches [1.0 millimeters] and about 0.19 inches [5 millimeters]. A most preferred range for dimension "I" is between about 0.04 inches [1.0 millimeters] and about 0.125 inches [3 millimeters]. The preferred dimension "I" is about 0.08 inches [2 millimeters].

FIG. 7 shows the axial length of the resilient retainer sleeve 80 wherein this length is shown by dimension "J". The typical range for dimension "J" is between about 0.20 inches [5 millimeters] and about 1.07 inches [27 millimeters]. A more preferred range for dimension "J" is between about 0.20 inches [5 millimeters] and about 0.62 inches [16 millimeters]. The axial length "J" of the resilient retainer sleeve 80 is less than the axial length "C" of the reduced diameter portion 74. The axial length "J" of the resilient retainer sleeve 80 is less than the diameter "H" of the reduced diameter portion 74 of the drilling bit body 60. In addition, the ratio of the axial length "J" of the resilient retainer sleeve 80 to the axial length "B" of the shank portion 72 ranges between about 0.10 and about 0.37, and more narrowly this ratio (J/B) ranges between about 0.11 and about 0.29.

The clearance between the interior surface 88 of the resilient retainer sleeve 80 and the surface 75 of the reduced diameter portion 74 (i.e., dimension "I") is at least as great as the thickness of the resilient retainer sleeve 80 (i.e., dimension "F") so as to satisfy the relationship: $I \geqq F$. This means that the ratio of the clearance to the thickness of the resilient retainer sleeve is equal to or greater than one. The ratio of the clearance between the interior surface 88 of the resilient retainer sleeve 80 and the surface 75 of the reduced diameter portion 74 (i.e., dimension "I") and the thickness of the resilient retainer sleeve 80 (i.e., dimension "F") is between 1.00 and about 3.125. More preferably, the ratio of the clearance between the interior surface 88 of the resilient retainer sleeve 80 and the surface 75 of the reduced diameter portion 74 (i.e., dimension "I") and the thickness of the resilient retainer sleeve 80 (i.e., dimension "F") is between 1.00 and about 1.29. The most preferred ratio I/F equals about 1.24.

Further referring to FIG. 7, the shank portion 72 of the drilling bit 38 is shown as being tightly received within the bore 50 of the holder 36 wherein the drilling bit 38 is rotatable with respect to the holder 36. In this regard, other than for the reduced diameter portion 74 of the shank portion 72 wherein the resilient retainer sleeve 80 is carried by the reduced diameter portion 74, the shank portion 72 is intended to form a tight rotational fit within the bore 50 of the holder 36. The clearance between the exterior surface 77 of the axial forward larger diameter portion 73 of the shank 72, as well as the clearance between the exterior surface 81 of the rearward portion 79 of the shank portion 72 is intended to be minimal for all or most drilling, construction, mining and other industrial rotating cutting bits. This minimal clearance between the exterior surface 77 of the axial forward larger diameter portion 73 of the shank 72 and the minimal clearance between the exterior surface 81 of the rearward portion 79 of the shank portion 72 helps to limit or minimize the play and/or wobble of the shank portion 72 (and of course the drilling bit 38) as it rotates during operation. As can be appreciated in the art, if a drilling bit 38 wobbles during operation it can cause damage and/or uneven wear (or non-uniform wear) to the bore of the holder.

Figure 8:
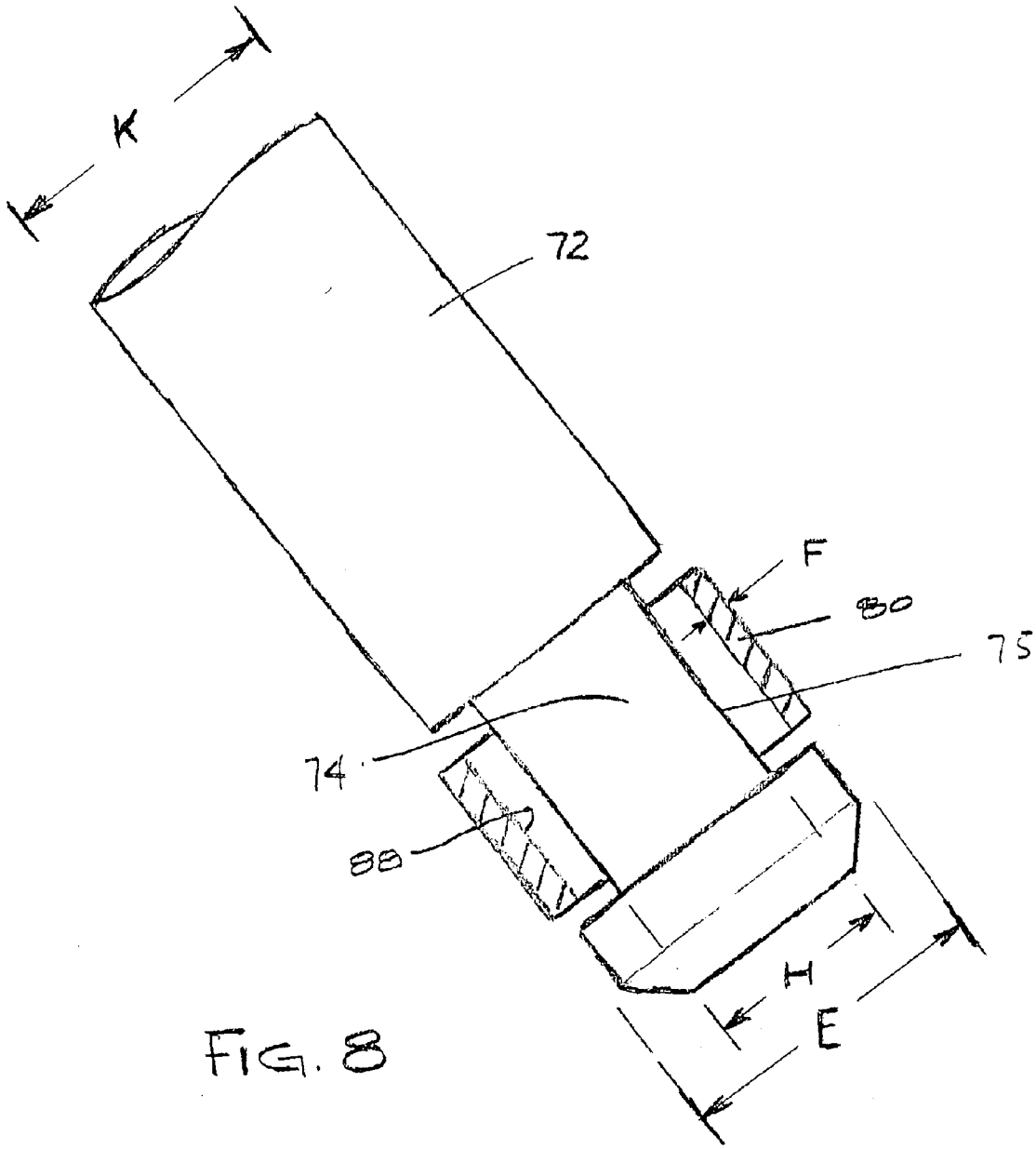
FIG. 8 is a side view of the axially rearward portion of the drilling bit assembly of the drilling bit body and the resilient retainer sleeve (illustrated in a compressed condition) wherein the resilient retainer sleeve is shown in cross-section so as to illustrate the clearance between the interior surface of the resilient retainer sleeve and the surface of the reduced diameter portion of the drilling bit body, and to illustrate the ratio (H/K) of the diameter (diameter "H") of the reduced diameter portion of the shank to the larger diameter (diameter "K") portion of the shank.

Referring to FIG. 8, which shows a portion of the drilling bit 38, the axial forward larger diameter portion 73 of the shank 72 has a diameter (i.e., shank diameter, "K". Diameter "K" has a dimension that ranges between about 0.505 inches (12.8 millimeters) and about 1.485 inches (37.7 millimeters). Another range for diameter "K" is between about 0.672 inches (17.1 millimeters) and about 1.181 inches (30.0 millimeters). Still another range for diameter "K" is between about 0.950 inches (24.1 millimeters) and about 1.050 inches (26.7 millimeters). Yet still another range for diameter "K" is between about 0.765 inches (19.4 millimeters) and about 0.990 inches (25.1 millimeters). As described hereinabove, the drilling bit body 60 has a reduced diameter portion 74 adjacent to the axial rearward end 64 thereof. The reduced diameter portion 74 has a diameter (i.e., groove diameter) "H" that ranges between about 0.400 inches (10.2 millimeters) to about 1.040 inches (26.4 millimeters). Diameter (i.e., groove diameter) "H" has another range between about 0.465 inches (11.8 millimeters) to about 0.895 inches (22.7 millimeters).

Table I set forth below presents the diameter (i.e., groove diameter) of the reduced diameter portion of the shank and the diameter (i.e., shank diameter) of the forward larger diameter portion of the shank for each one of a number of different styles (Tools 1 through 9) of tools, as well as the ratio of the diameter (i.e., the groove diameter) of the reduced diameter portion of the shank and the diameter (i.e., the shank diameter) of the forward larger diameter portion the shank for each one of these tools.

TABLE I

Selected Dimensions and Ratios for Certain Rotatable Bits

| Tool | Diameter of Reduced Diameter Portion (inches/millimeters) | Diameter of the Forward Larger Diameter Portion (inches/millimeters) | Ratio of Diameter of the Reduced Diameter Portion to the Diameter of the Forward Larger Diameter Portion |
|---|---|---|---|
| 1 | 0.525/13.4 | 0.735/18.7 | 0.71 |
| 2 | 0.555/14.1 | 0.765/19.4 | 0.73 |
| 3 | 0.707/18.0 | 0.990/25.1 | 0.71 |
| 4 | 0.790/20.1 | 0.990/25.1 | 0.80 |
| 5 | 0.722/18.3 | 0.990/25.1 | 0.73 |
| 6 | 0.895/22.7 | 1.181/30.0 | 0.76 |
| 7 | 0.465/11.8 | 0.672/17.1 | 0.69 |
| 8 | 0.400/10.2 | 0.505/12.8 | 0.79 |
| 9 | 1.040/26.4 | 1.485/37.7 | 0.70 |

One exemplary tool is Tool 5 that uses a resilient retainer sleeve that has a thickness of 0.060 inches. What this shows is that the resilient retainer sleeve 80 has a thickness "F" (0.060 inches/1.5 millimeters) that is less than one-half (i.e., about 22.4 percent [0.060/0.268]) of the dimensional difference (0.990−0.722=0.268 inches) between the shank diameter (0.990 inches) and the groove diameter (0.722 inches). In a broader aspect, applicant contemplates that the thickness of the resilient retainer sleeve can be less than or equal to one-half of the dimensional difference between the shank diameter and the groove diameter. In narrower aspects, the resilient retainer sleeve can have a thickness that is between about 0.15 to about 0.40 of the dimensional difference between the shank diameter and the groove diameter. In a still narrower aspect, the resilient retainer sleeve can have a thickness that is between about 0.20 to about 0.30 of the dimensional difference between the shank diameter and the groove diameter. In yet a still narrower aspect, the resilient retainer sleeve can have a thickness that is between about 0.20 to about 0.25 of the dimensional difference between the shank diameter and the groove diameter.

The above Table I shows that there is a range of the ratio of the groove diameter ("H") to the shank diameter ("K") for these seven tools. It is shown that the ratio of the groove diameter to the shank diameter ranges between about 0.69 and about 0.80. In a narrower aspect, the ratio of the groove diameter to the shank diameter ranges between about 0.70 and about 0.75.

By providing a resilient retainer sleeve 80 and a drilling bit body 60 that has a reduced diameter portion 74 that have the above mentioned dimensional relationships, applicant has been able to provide a drilling bit assembly that provides sufficient clearance between the interior surface 88 of the resilient retainer sleeve 80 and the surface 75 of the reduced diameter portion 74 so as to reduce the tendency for drilling debris and dirt to become lodged (or collect) in that clearance volume thereby restricting the ability of the resilient retainer sleeve 80 to compress upon the drilling bit being struck on the rear surface.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A drilling bit for use in conjunction with a holder having a bore, the drilling bit comprising:

a drilling bit body having an axial forward end and an axial rearward end, the drilling bit body farther including a reduced diameter portion adjacent to the axial rearward end thereof defining a reduced diameter surface;

a hard insert affixed to the drilling bit body at the axial forward end thereof;

a resilient retainer sleeve having a first thickness and presenting an interior surface, and the retainer sleeve being carried by the drilling bit body within the reduced diameter portion;

the resilient retainer sleeve being in an expanded condition when the drilling bit is not within the bore of the holder and the resilient retainer sleeve being in a compressed condition when the drilling bit being within the bore of the holder; and the clearance between the reduced diameter surface of the drilling bit body and the interior surface of the resilient retainer sleeve when the resilient retainer sleeve is in its compressed condition being at least as great as the first thickness of the resilient retainer sleeve.

2. The drilling bit according to claim 1 wherein the clearance between the reduced diameter surface of the drilling bit body and the interior surface of the resilient retainer sleeve when the resilient retainer sleeve is in its compressed condition is between 1 and about 3.125 times as great as the first thickness of the resilient retainer sleeve.

3. The drilling bit according to claim 1 wherein the clearance between the reduced diameter surface of the drilling bit body and the interior surface of the resilient retainer sleeve when the resilient retainer sleeve is in its compressed condition is between 1 and about 1.29 times as great as the first thickness of the resilient retainer sleeve.

4. The drilling bit according to claim 1 wherein the resilient retainer sleeve presents an exterior surface, and the exterior surface of the resilient retainer sleeve is generally smooth.

5. The drilling bit according to claim 1 wherein the bore of the holder passes completely through the holder.

6. The drilling bit according to claim 1 wherein the resilient retainer sleeve has an axial length, and the drilling bit body having a shank portion at the axial rearward end thereof, the shank portion having an axial length, and the ratio of the axial length of the resilient retainer sleeve to the axial length of the shank portion ranging between about 0.10 and about 0.37.

7. The drilling bit according to claim 6 wherein the ratio of the first axial length to the second axial length ranging between about 0.11 and about 0.29.

8. A rotatable bit assembly for use in an operation to engage a substrate wherein the rotatable bit is generally continuous engagement with the substrate, the assembly comprising:

a holder having a bore;

a rotatable bit including a rotatable bit body having an axial forward end and an axial rearward end, the rotatable bit body further including a reduced diameter portion adjacent to the axial rearward end thereof defining a reduced diameter surface;

a hard insert affixed to the rotatable bit body at the axial forward end thereof;

a resilient retainer sleeve having a thickness and presenting an interior surface, and the retainer sleeve being carried by the rotatable bit body within the reduced diameter portion;

the resilient retainer sleeve being in an expanded condition when the rotatable bit is not within the bore of the holder and the resilient retainer sleeve being in a compressed condition when the rotatable bit being within the bore of the holder; and the clearance between the reduced diameter surface of the rotatable bit body and the interior surface of the resilient retainer sleeve when the resilient retainer sleeve is in its compressed condition being at least as great as the thickness of the resilient retainer sleeve.

9. The rotatable bit assembly of claim 8 wherein the bore passes completely through the holder.

10. The rotatable bit assembly according to claim 8 wherein the resilient retainer sleeve presents an exterior surface, and the exterior surface of the resilient retainer sleeve is generally smooth.

11. The rotatable bit assembly according to claim 8 wherein the clearance between the reduced diameter surface of the rotatable bit body and the interior surface of the resilient retainer sleeve when the resilient retainer sleeve is in its compressed condition is between 1 and about 3.125 times as great as the thickness of the resilient retainer sleeve.

12. The rotatable bit assembly according to claim 8 wherein the clearance between the reduced diameter surface of the rotatable bit body and the interior surface of the resilient retainer sleeve when the resilient retainer sleeve is in its compressed condition is between 1 and about 1.29 times as great as the thickness of the resilient retainer sleeve.

13. A resilient retainer sleeve for use on a rotatable drilling bit retained in a bore of a holder wherein the drilling bit body has an axial forward end and an axial rearward end with a shank adjacent the axial rearward end, the drilling bit body further includes a reduced diameter portion in the shank defining a reduced diameter surface, the resilient retainer sleeve comprising:

a retainer sleeve body having a thickness and presenting an interior surface, and the retainer sleeve body being carried by the drilling bit body within the reduced diameter portion;

the retainer sleeve body being in an expanded condition when the drilling bit is not within the bore of the holder and the retainer sleeve body being in a compressed condition when the drilling bit being within the bore of the holder; and the clearance between the reduced diameter surface of the drilling bit body and the interior surface of the retainer sleeve body when the retainer sleeve body is in its compressed condition being at least as great as the thickness of the retainer sleeve body.

14. The retainer sleeve of claim 13 wherein the clearance between the reduced diameter surface of the drilling bit body and the interior surface of the resilient retainer sleeve when the resilient retainer sleeve is in a compressed condition is between 1 and about 3.125 times the thickness of the resilient retainer sleeve.

15. The retainer sleeve of claim 13 wherein the clearance between the reduced diameter surface of the drilling bit body and the interior surface of the resilient retainer sleeve when the resilient retainer sleeve is in a compressed condition is between 1 and about 1.29 times the thickness of the resilient retainer sleeve.

16. The retainer sleeve of claim 13 wherein the resilient retainer sleeve having an axial length.

17. The resilient retainer sleeve of claim 16 wherein the shank portion of the drilling bit body having an axial length, and the ratio of the axial length of the resilient retainer sleeve to the axial length of the shank portion ranging between about 0.10 and about 0.37.

18. The resilient retainer sleeve of claim 16 wherein the shank portion of the drilling bit body having an axial length, and the ratio of the axial length of the resilient retainer sleeve to the axial length of the shank portion ranging between about 0.11 and about 0.29.

19. An auger drill for engaging a substrate, the auger drill comprising:

a central auger shaft;

a helical flight on the auger shaft, and the helical flight having a leading edge;

at least one drilling bit connected to the helical flight adjacent the leading edge wherein the drilling bit is retained in a bore of a holder;

the drilling bit comprising:

a drilling bit body having an axial forward end and an axial rearward end, the drilling bit body further including a reduced diameter portion adjacent to the axial rearward end thereof defining a reduced diameter surface;

a hard insert affixed to the drilling bit body at the axial forward end thereof;

a resilient retainer sleeve having a thickness and presenting an interior surface, and the retainer sleeve being carried by the drilling bit body within the reduced diameter portion;

the resilient retainer sleeve being in an expanded condition when the drilling bit is not within the bore of the holder and the resilient retainer sleeve being in a compressed condition when the drilling bit being within the bore of the holder; and the clearance between the reduced diameter surface of the drilling bit body and the interior surface of the resilient retainer sleeve when the resilient retainer sleeve is in its compressed condition being at least as great as the thickness of the resilient retainer sleeve.

20. A drilling bit for use in conjunction with a holder having a bore, the drilling bit comprising:

a drilling bit body having an axial forward end and an axial rearward end, the drilling bit body further including a adjacent to the axial rearward end thereof, and the shank containing a reduced diameter portion that defines a reduced diameter surface, the reduced diameter portion having a diameter;

a hard insert affixed to the drilling bit body at the axial forward end thereof;

a resilient retainer sleeve having a thickness and presenting an interior surface, and the retainer sleeve being carried by the drilling bit body within the reduced diameter portion; and the ratio of the thickness of the resilient retainer sleeve to the diameter of the reduced diameter portion ranges between about 0.08 and about 0.12.

21. The drilling bit of claim 20 wherein the resilient retainer sleeve being in an expanded condition when the drilling bit is not within the bore of the holder and the resilient retainer sleeve being in a compressed condition when the drilling bit being within the bore of the holder; and the clearance between the reduced diameter surface of the drilling bit body and the interior surface of the resilient retainer sleeve when the resilient retainer sleeve is in its compressed condition being at least as great as the first thickness of the resilient retainer sleeve.

22. The drilling bit of claim 20 wherein the drilling bit is in substantially continuous engagement with the substrate during the drilling operation.

23. A drilling bit comprising:

a drilling bit body having an axial forward end and an axial rearward end;

the drilling bit body further including a reduced diameter portion adjacent to the axial rearward end thereof, the reduced diameter portion having a groove diameter and having a groove surface; and a larger diameter shank portion axial forward of the reduced diameter portion, the larger diameter shank portion having a shank diameter and having a shank surface;

a hard insert affixed to the drilling bit body at the axial forward end thereof;

a resilient retainer sleeve being carried by the drilling bit body within the reduced diameter portion; and the resilient retainer sleeve having a thickness that is less than or equal to one-half of the dimensional difference between the shank surface and the groove surface.

24. The drilling bit of claim 23 wherein the ratio of the groove diameter to the shank diameter ranges between about 0.69 and about 0.80.

25. The drilling bit of claim 23 wherein the ratio of the groove diameter to the shank diameter ranges between about 0.70 and about 0.75.

26. The drilling bit of claim 23 wherein the resilient retainer sleeve having a thickness that is between about 0.15 to about 0.40 of the dimensional difference between the shank diameter and the groove diameter.

27. The drilling bit of claim 23 wherein the resilient retainer sleeve having a thickness that is between about 0.20 to about 0.30 of the dimensional difference between the shank diameter and the groove diameter.

28. The drilling bit of claim 23 wherein the resilient retainer sleeve having a thickness that is between about 0.20 to about 0.25 of the dimensional difference between the shank diameter and the groove diameter.

29. A drilling bit comprising:

a drilling bit body having an axial forward end and an axial rearward end;

the drilling bit body further including a reduced diameter portion adjacent to the axial rearward end thereof, the reduced diameter portion having a groove diameter; and a larger diameter shank portion axial forward of the reduced diameter portion, the larger diameter shank portion having a shank diameter;

a hard insert affixed to the drilling bit body at the axial forward end thereof;

a resilient retainer sleeve being carried by the drilling bit body within the reduced diameter portion, the resilient retainer sleeve having an exterior surface that is generally smooth; and the ratio of the groove diameter to the shank diameter ranges between about 0.69 and about 0.80.

30. The drilling bit of claim 29 wherein the ratio of the groove diameter to the shank diameter ranges between about 0.70 and about 0.75.

31. The drilling bit of claim 29 the resilient retainer sleeve having a thickness that is less than or equal to one-half of the dimensional difference between the shank diameter and the groove diameter.

32. The drilling bit of claim 29 wherein the resilient retainer sleeve having a thickness that is between about 0.15 to about 0.40 of the dimensional difference between the shank diameter and the groove diameter.

33. The drilling bit of claim 29 wherein the resilient retainer sleeve having a thickness that is between about 0.20 to about 0.30 of the dimensional difference between the shank diameter and the groove diameter.

34. The drilling bit of claim 29 wherein the resilient retainer sleeve having a thickness that is between about 0.20 to about 0.25 of the dimensional difference between the shank diameter and the groove diameter.

* * * * *